US010415235B2

(12) United States Patent
Jie et al.

(10) Patent No.: US 10,415,235 B2
(45) Date of Patent: Sep. 17, 2019

(54) SELF-HEAT PRESERVATION BUILDING STRUCTURE

(71) Applicant: FENG HE YING ZAO GROUP CO., LTD., Nanchang, Jiangxi Province (CN)

(72) Inventors: Baoru Jie, Nanchang (CN); Jiangang Jie, Nanchang (CN); Hongyang Xie, Nanchang (CN); Zhihui Yao, Nanchang (CN); Shuangxi Zhou, Nanchang (CN); Sheng Qian, Nanchang (CN); Yuchun Chen, Nanchang (CN); Wujin Tao, Nanchang (CN); Wen Liu, Nanchang (CN); Xin He, Nanchang (CN); Luolong Zhan, Nanchang (CN)

(73) Assignee: Feng He Ying Zao Group Co., Ltd., Nanchang (CN)

( * ) Notice: Subject to any disclaimer, the term of this patent is extended or adjusted under 35 U.S.C. 154(b) by 0 days.

(21) Appl. No.: 15/979,691

(22) Filed: May 15, 2018

(65) Prior Publication Data

US 2019/0177967 A1 Jun. 13, 2019

(30) Foreign Application Priority Data

May 15, 2017 (CN) ..... 2017 2 0532089 U

(51) Int. Cl.
*E04B 1/74* (2006.01)
*E04B 1/00* (2006.01)
(Continued)

(52) U.S. Cl.
CPC ..... *E04B 1/74* (2013.01); *E04B 1/0023* (2013.01); *E04B 1/10* (2013.01); *E04B 2001/5881* (2013.01)

(58) Field of Classification Search
CPC ..... E04B 1/74; E04B 1/0023
(Continued)

(56) References Cited

U.S. PATENT DOCUMENTS 3,879,907 A * 4/1975 Olson ..... E02D 27/42 248/539
4,364,688 A * 12/1982 Bitvai ..... E01F 9/638 404/10

(Continued)

*Primary Examiner* — Paola Agudelo
(74) *Attorney, Agent, or Firm* — Andrus Intellectual Property Law, LLP

(57) ABSTRACT

The present utility model relates to a building structure, and in particular to a self-heat preservation building structure applied to extremely severe cold regions. The self-heat preservation building structure adopts a wood material, and comprises an independent foundation, a floor, a wallboard, a ceiling board and a roof board, wherein the independent foundation is disposed on a hard groundwork, and the upper end part of the independent foundation is provided with spigots for mounting wooden pillars; mortises are disposed in the lower ends of the wooden pillars and configured to mount longitudinal and transverse ground beams, and the upper ends of the wooden pillars are provided with criss-cross straight slots which are configured to mount longitudinal and transverse wooden beams; wooden square beams are mounted between the ground beams and between the wooden beams, and the wooden beams are provided with wooden braces; the floor and the ceiling board are respectively paved on the wooden square beams; the wallboard is spliced with the ground beams and the wooden beams in a mortise-tenon manner; the roof board is mounted on the wooden braces; and the wallboard is provided with a window opening for mounting a heat preservation window and a doorway for a wooden door. The self-heat preservation building structure has the following advantages: (1) the mortise-tenon structure is adopted, and (2) the original ecological environment of the extremely severe cold regions is protected.

6 Claims, 8 Drawing Sheets

(51) Int. Cl.
*E04B 1/10* (2006.01)
*E04B 1/58* (2006.01)

(58) Field of Classification Search
USPC ..... 52/298, 299
See application file for complete search history.

(56) References Cited

U.S. PATENT DOCUMENTS 5,392,575 A * 2/1995 Hoffman ..... E02D 27/02 52/169.9
8,272,182 B1 * 9/2012 Spiegel ..... E04B 1/24 52/404.2
2002/0088184 A1 * 7/2002 Hiraki ..... E04B 1/74 52/79.1
2006/0010790 A1 * 1/2006 Perry ..... E02D 35/00 52/98
2007/0175138 A1 * 8/2007 Jensen ..... E02D 27/01 52/299
2007/0224003 A1 * 9/2007 Janesky ..... B32B 27/12 405/270
2008/0263968 A1 * 10/2008 Day ..... E04B 1/34321 52/79.1
2009/0000235 A1 * 1/2009 Kieran ..... E04B 1/24 52/656.9
2009/0301014 A1 * 12/2009 Becher ..... E04B 1/74 52/302.1
2010/0293867 A1 * 11/2010 Bathon ..... E04B 1/14 52/79.1
2013/0055669 A1 * 3/2013 Olszewski ..... B32B 3/06 52/283
2014/0013684 A1 * 1/2014 Kelly ..... E04B 1/08 52/235
2014/0190120 A1 * 7/2014 Warren ..... E04F 13/007 52/747.1

* cited by examiner

SELF-HEAT PRESERVATION BUILDING STRUCTURE

FIELD OF THE INVENTION

The present utility model relates to a building structure, and in particular to a self-heat preservation building structure applied to extremely severe cold regions.

DESCRIPTION OF THE PRIOR ART

Due to the changes of longitudes, latitudes on the earth, solar elevation angles, etc., the air temperature differences across respective regions are changed therewith. The highest temperature of the hottest location in the world can reach 58.8° C., while the lowest temperature of the Antarctic continent is −89.6° C., the lowest temperature of the Arctic continent is −59° C., and the lowest temperature of northeast China is −52.3° C. In severe cold regions, the thermal loss of external building envelope structures is larger than that in non-severe cold regions. A wall body is a main portion for the external building envelope, energy saving for outer wall plays an important role, and when buildings in the extremely severe cold regions have a self-heat preservation function, energy consumption caused by lots of thermal loss of heat supply systems, illumination and hot water supply can be reduced.

SUMMARY OF THE INVENTION

An objective of the present utility model is to provide a building structure which can be assembled on site, is low in cost, high in benefit, durable and high in safety and has a self-heat preservation function.

In order to realize the above objective, the present utility model adopts the following technical solution: a self-heat preservation building structure adopts a wood material and comprises an independent foundation, a floor, a wallboard, a ceiling board and a roof board, wherein the independent foundation is disposed on a hard groundwork, and the upper end part of the independent foundation is provided with spigots for mounting wooden pillars; mortises are disposed in the lower ends of the wooden pillars and configured to mount longitudinal and transverse ground beams, and the upper ends of the wooden pillars are provided with criss-cross straight slots which are configured to mount longitudinal and transverse wooden beams; wooden square beams are mounted between the ground beams and between the wooden beams, and the wooden beams are provided with wooden braces; the floor and the ceiling board are respectively paved on the wooden square beams; the wallboard is spliced with the ground beams and the wooden beams in a mortise-tenon manner; the roof board is mounted on the wooden braces; and the wallboard is provided with a window opening for mounting a heat preservation window and a doorway for a wooden door.

Preferably, the spigot of the independent foundation is a trapezoid opening with a large upper end and a small lower end.

Preferably, the opposite surfaces of the independent foundation are provided with a tongue-and-groove joint and an end port for containing a bolt, respectively.

Preferably, one end or two opposite ends of a straight slot opening in the upper end of the wooden pillar are provided with corbels, and the upper end surfaces of the corbels are kept flush with the bottom surfaces of the straight slots.

Preferably, each of the floor, the wallboard, the ceiling board and the roof board adopts a tongue-and-groove shaped three-layer sandwich combination, a sandwich layer is filled with a light heat preservation material, and three layers of boards are linked and fixed by bolts.

Preferably, the outer sides of the roof board and the wallboard are coated with an anti-radiation, anticorrosive and waterproof material.

A mounting method comprises the following steps:

(1) placing the independent foundation made of a natural wood material on a hard groundwork, wherein such a wood material has certain corrosion resistance per se, and is assembled into the independent foundation after the treatment for corrosion resistance and moth proofing, and the independent foundation is placed under frozen soil and buried by lime concrete;

(2) mounting the wooden pillars on the independent foundation, wherein wooden pillars are spliced with the wooden beams, the ground beams and bamboo nails in longitudinal and transverse directions, the wooden square beams are mounted between the ground beams and between the wooden beams, and the wooden braces are mounted on the wooden beams; and (3) paving the floor and the ceiling board on the wooden square beams and fixing with glue plus steel nails, linking the wallboard with the ground beams and the wooden beams by splicing in a mortise-tenon manner, and mounting the roof board on the wooden braces.

The beams, the pillars and the boards of the wooden building structure all adopt the natural wood material, the wallboard, the floor, the ceiling board and the roof board adopt the tongue-and-groove shaped three-layer sandwich combination, the wood material is treated by the processes for corrosion resistance, fire proofing, moth proofing, etc., the sandwich layer is filled with the light heat preservation material, and the three layers of boards are linked and fixed by bolts, so as to form an integral object. The ceiling board is a stress-free member, and is in an indoor environment, and the material for the ceiling board can be adjusted to a thin type properly. Water resistance is considered for the outer sides of the roof board and the wallboard, therefore, the anti-radiation, anticorrosive and waterproof material is required to be brushed to resist the corrosion of high radiation, freezing rain, and rain and snow in the severe cold regions to the building.

Compared with the prior art, the present utility model has the following advantages.

1. By adopting a mortise-tenon structure, the building structure can be well designed according to a standardized modulus, can be produced industrially, and can be assembled on site, and the building structure is low in cost, high in benefit, durable, and high in safety, and has a self-heat preservation function and obvious economic benefits in long time use.

2. The original ecological environment of the extremely severe cold regions is better protected.

DETAILED DESCRIPTION OF THE PREFERRED EMBODIMENTS

The present utility model is further described in detail in combination with FIGS. 1 to 16.

Figure 1:
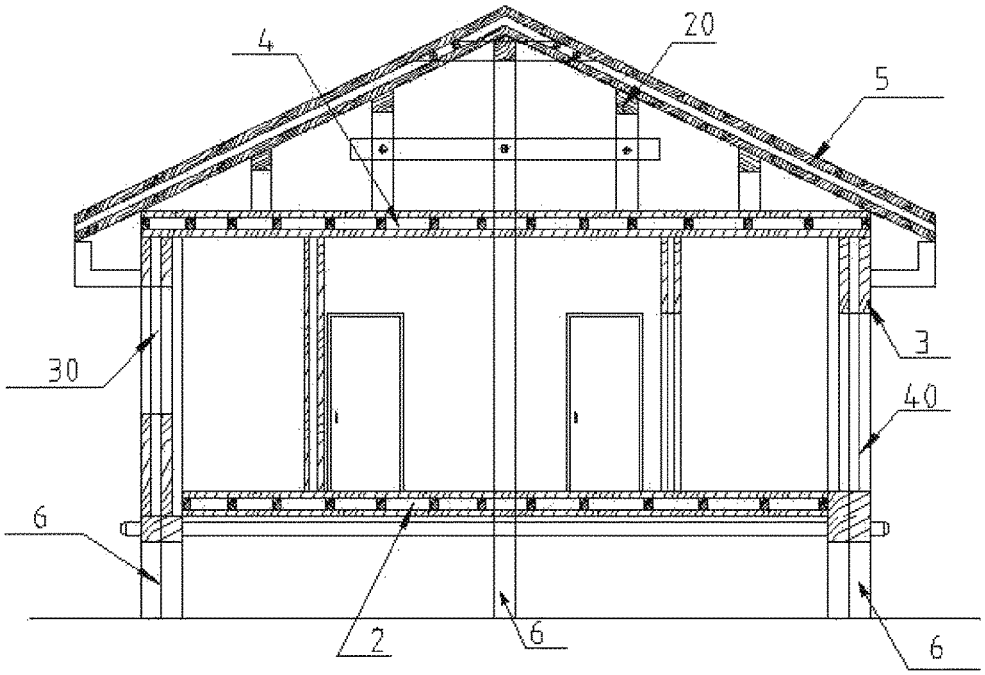
FIG. 1 is a sectional view of the present utility model.
Figure 2:
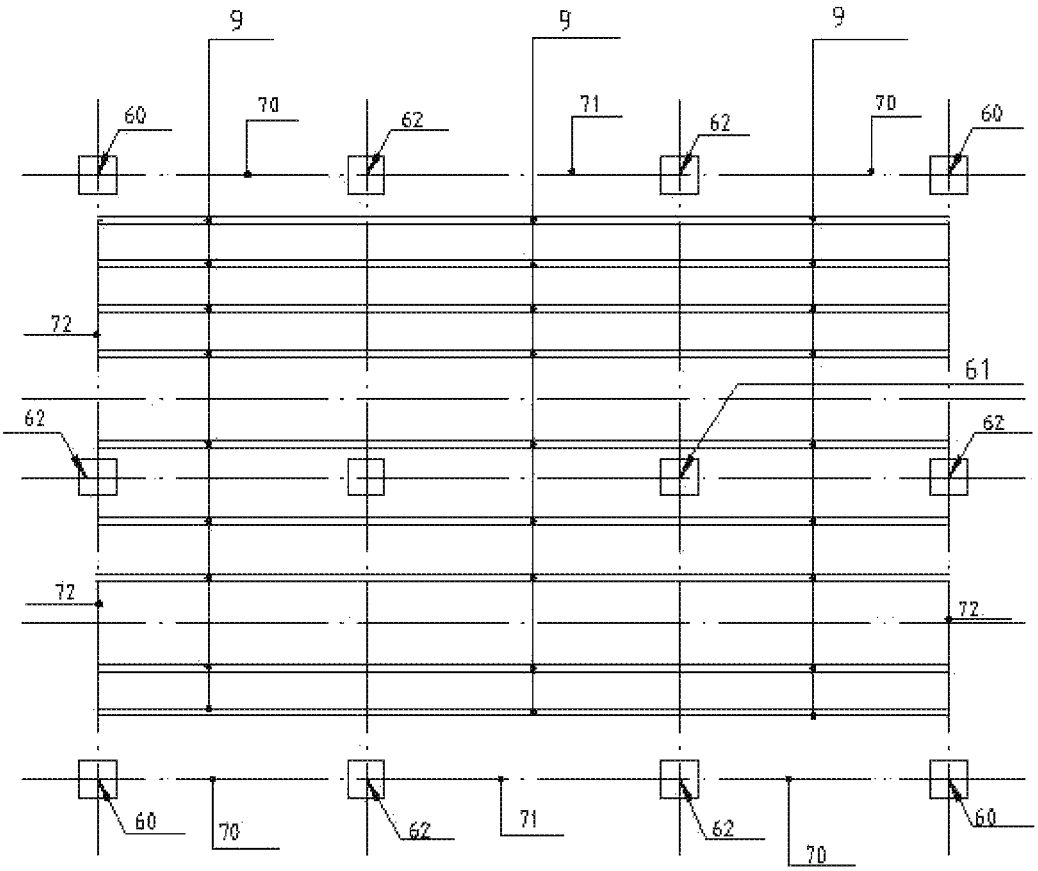
FIG. 2 is a structural schematic view of a ground floor of the present utility model.
Figure 3:
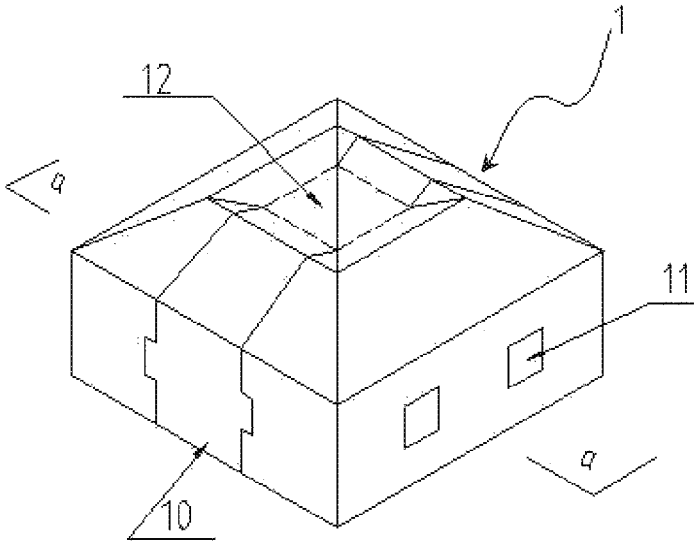
FIG. 3 is a structural schematic view of an independent foundation of an embodiment of the present utility model.
Figure 4:
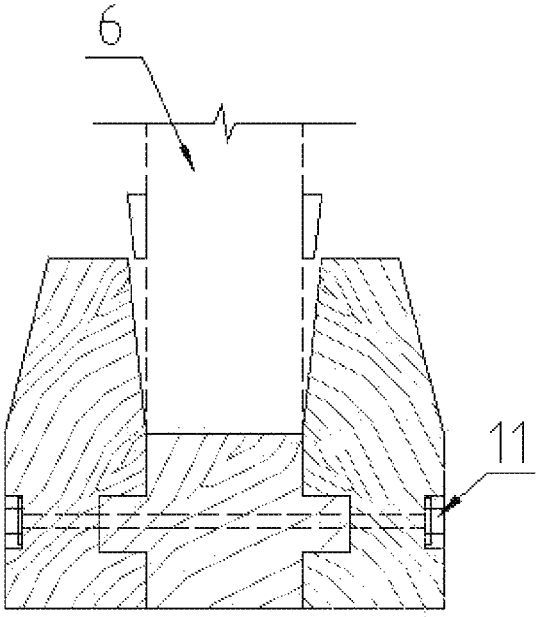
FIG. 4 is an A-A sectional view of FIG. 3.
Figure 8:
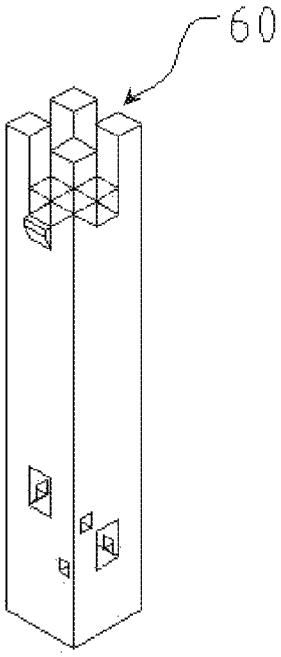
FIG. 8 is a structural schematic view of a wooden pillar I of an embodiment of the present utility model.
Figure 9:
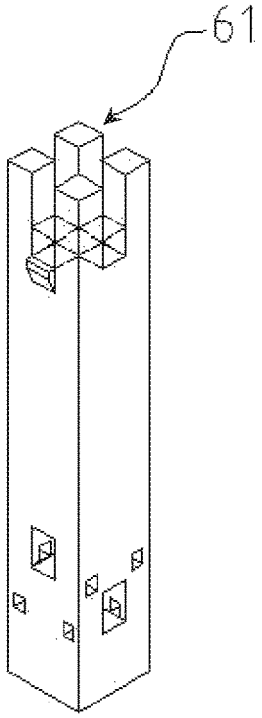
FIG. 9 is a structural schematic view of a wooden pillar II of an embodiment of the present utility model.
Figure 10:
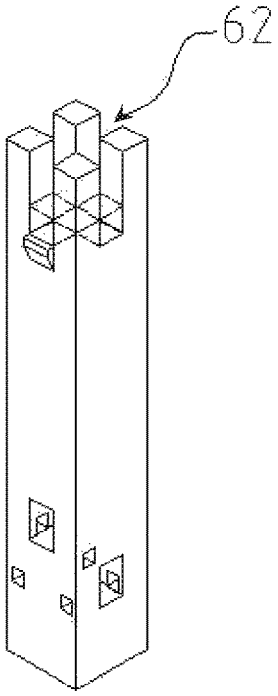
FIG. 10 is a structural schematic view of a wooden pillar III of an embodiment of the present utility model.
Figure 11:
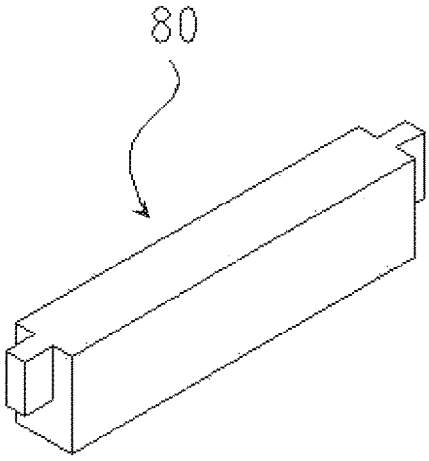
FIG. 11 is a structural schematic view of a wooden beam I of an embodiment of the present utility model.
Figure 12:
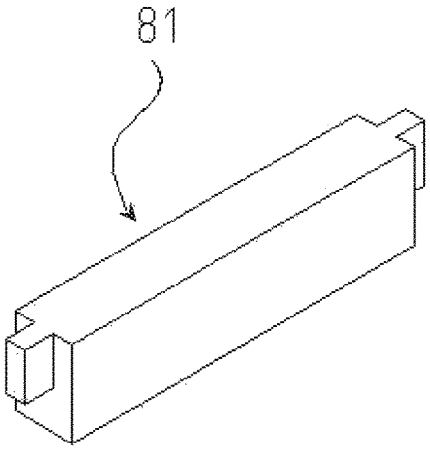
FIG. 12 is a structural schematic view of a wooden beam II of an embodiment of the present utility model.
Figure 13:
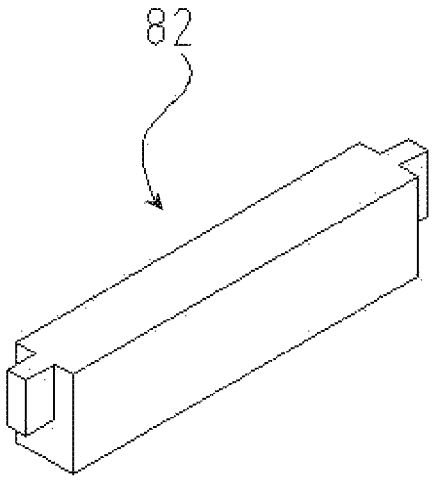
FIG. 13 is a structural schematic view of a wooden beam III of an embodiment of the present utility model.
Figure 14:
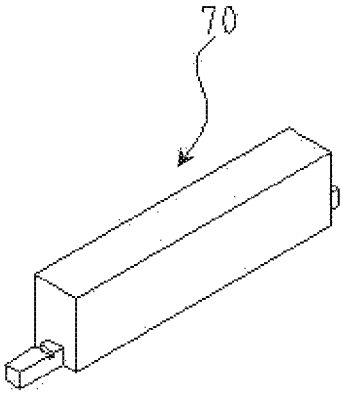
FIG. 14 is a structural schematic view of a ground beam I of an embodiment of the present utility model.
Figure 15:
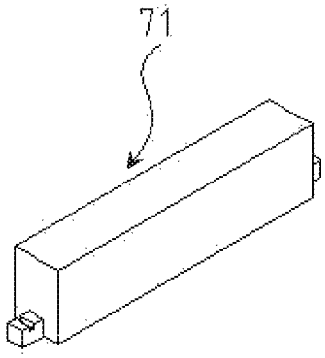
FIG. 15 is a structural schematic view of a ground beam II of an embodiment of the present utility model.
Figure 16:
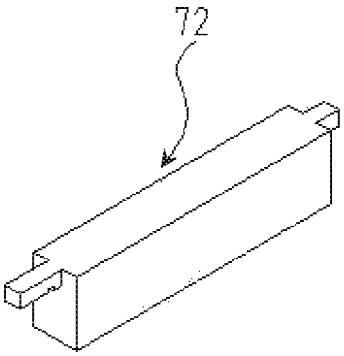
FIG. 16 is a structural schematic view of a ground beam III of an embodiment of the present utility model.

As shown in FIG. 1, a self-heat preservation building structure adopts a wood material and comprises an independent foundation 1, a floor 2, a wallboard 3, a ceiling board 4 and a roof board 5. As shown in FIGS. 3 and 4, the independent foundation 1 is a splicing structure, and every two independent foundations are connected by a tongue-and-groove joint 10, are fixed by bolts 11 on bolt end ports disposed opposite to the tongue-and-groove joint, and are placed on a hard groundwork. The upper end part of the spliced independent foundation is provided with a spigot 12 for mounting a wooden pillar, and the spigot is a trapezoid opening with a large upper end and a small lower end. As shown in FIGS. 8 to 10, wooden pillars 6 comprise a wooden pillar I 60, a wooden pillar II 61 and a wooden pillar II 62, two staggered mortises are disposed in each of the adjacent surfaces on the lower end of the wooden pillar I 60 and comprise a large mortise and a small mortise, and the small mortise penetrates through the large mortise vertical to the position of the small mortise. Three staggered mortises are disposed in each of the adjacent surfaces on the lower end of the wooden pillar II 61 and comprise one large mortise and two small mortises, and the small mortises penetrate through the large mortise vertical to the positions of the small mortises. Three mortises and two mortises are respectively formed in the adjacent surfaces on the lower end of the wooden pillar m 62, wherein there are one large mortise and the rest small mortises respectively in the three mortises and the two mortises, the small mortise penetrates through the large mortise vertical to the position of the small mortise, the large mortises are configured to mount longitudinal and transverse ground beams, and the small mortises are configured to be inserted by bamboo nails, so as to fix the ground beams and the wooden pillars. The upper ends of the wooden pillars are provided with criss-cross straight slots, one end or two opposite ends of the straight slot opening are provided with corbels, and the upper end surfaces of the corbels are flush with the bottom surfaces of the straight slots and configured to mount longitudinal or transverse wooden beams. As shown in FIGS. 2 and 11 to 16, the ground beams comprise a ground beam I 70, a ground beam II 71 and a ground beam III 72, and the wooden beams comprise a wooden beam I 80, a wooden beam II 81 and a wooden beam III 82, wherein wooden square beams 9 are mounted between the ground beams and between the wooden beams, and the wooden beams are provided with wooden braces 20. The floor 2 and the ceiling board 4 are respectively paved on the wooden square beams 9. The wallboard 3 is spliced with the ground beams and the wooden beams in a mortise-tenon manner. The roof board 5 is mounted on the wooden braces. The wallboard is provided with a window opening for mounting a heat preservation window 30 and a doorway for mounting a wooden door 40.

A mounting method comprises the following steps:

(1) placing the independent foundation made of a natural wood material on the hard groundwork, wherein such a wood material has certain corrosion resistance per se, and is assembled into the independent foundation after the treatments for corrosion resistance and moth proofing, and the independent foundation is placed under frozen soil and buried by lime concrete;

(2) mounting the wooden pillars on the independent foundation, wherein the wooden pillars are spliced with the wooden beams, the ground beams and the bamboo nails in longitudinal and transverse directions, the wooden square beams are mounted between the ground beams and between the wooden beams, and the wooden braces are mounted on the wooden beams; and (3) paving the floor and the ceiling board on the wooden square beams and fixing with glue plus steel nails, linking the wallboard with the ground beams and the wooden beams by splicing in a mortise-tenon manner, and mounting the roof board on the wooden braces.

Figure 5:
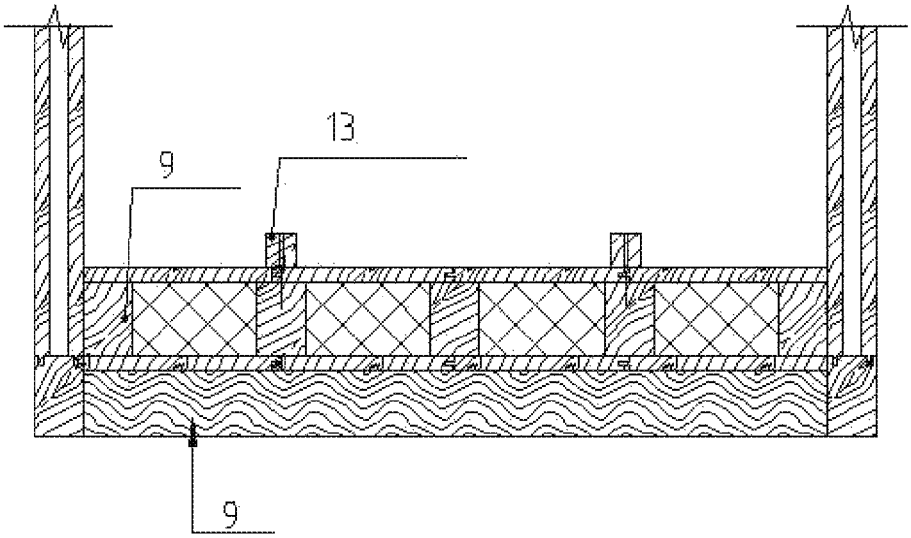
FIG. 5 is a structural schematic view of a floor of an embodiment of the present utility model.
Figure 6:
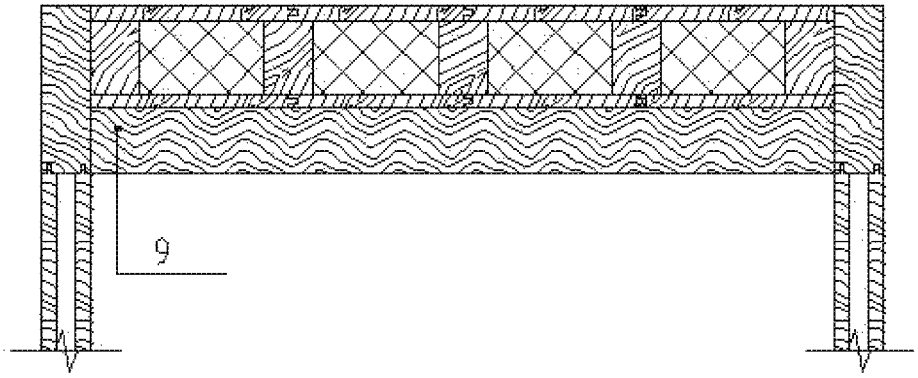
FIG. 6 is a structural schematic view of a ceiling board of an embodiment of the present utility model.
Figure 7:
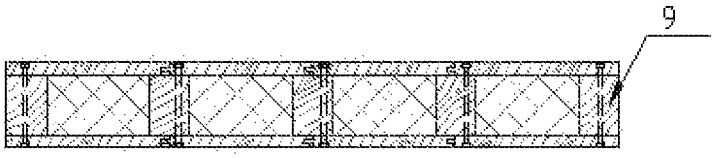
FIG. 7 is a structural schematic view of a roof board of an embodiment of the present utility model.

As shown in FIGS. 5 to 7, the beams, the pillars and the boards of the wooden building structure all adopt the natural wood material, the wallboard, the floor, the ceiling board and the roof board all adopt the tongue-and-groove shaped three-layer sandwich combination, the wood material is treated by the processes for corrosion resistance, fire proofing, moth proofing, etc., the sandwich layer is filled with a light heat preservation material, and the three layers of boards are linked and fixed by the bolts, so as to form an integral object. For example, the bottom surface of the floor is a dampproof layer of a wooden board with a tongue-and-groove shape, the top surface of the floor is a floor surface layer with a tongue-and-groove shape, and the middle portion of the floor is filled with a heat preservation cotton layer. The bottom surface of the ceiling board is an inner board of a ceiling board with a tongue-and-groove shape, the top surface of the ceiling board is a top board of a ceiling board with a tongue-and-groove shape, and the middle of the ceiling board is filled with a heat preservation material. The ceiling board is a stress-free member, and is in an indoor environment, so its material can be adjusted to a thin type properly. Water resistance is considered for the outer sides of the roof board and the wallboard, therefore, an anti-radiation, anticorrosive and waterproof material is required to be brushed to resist the corrosion of high radiation, freezing rain, and rain and snow in the severe cold regions to the building. Meanwhile, in order to enhance the steadiness between the floor and the wallboard, additional square beams 13 can be increased on the floor and be fixed by screws.

The ground floor is an overhead ground, the overhead height of which is determined according to local folkways and specific natural environment types, but at least, the overhead height should not be lower than 1.60 m. The design process is suitable for a building with two storeys or less, and the reasonable durable years are more than two hundred years. The combined wall bodies, ceilings, buildings and ground objects adapting the present design are suitable for the existing various types of internal self-heat preservation reconstructions, so as to achieve the long-term energy saving effect.

The foregoing embodiments are preferred embodiments of the present utility model without limiting the present utility model. Any improvements based on the structure herein belong to a protective scope of the present utility model.

The invention claimed is:

1. A self-heat preservation building structure made of a wood material and comprising:

at least one independent foundation, a floor, a wallboard, a ceiling board and a roof board, wherein the at least one independent foundation is made of wood and disposed on a hard groundwork, and the upper end part of the at least one independent foundation comprising spigots for mounting wooden pillars;

wooden pillars mounted to each of the spigots, said wooden pillars comprising mortises disposed in lower ends of each of the wooden pillars and configured to mount longitudinal and transverse ground beams, and criss-cross straight slots provided on upper ends of each of the wooden pillars, said criss-cross straight slots are configured to mount longitudinal and transverse wooden beams;

wooden square beams mounted between the ground beams and between the wooden beams, wherein the wooden beams are provided with wooden braces;

the floor and the ceiling boards are respectively paved on the wooden square beams;

the wallboard is spliced with the ground beams and the wooden beams in a mortise-tenon manner, the roof board is mounted on the wooden braces; and wherein the wallboard is provided with a window opening for mounting a heat preservation window and a doorway for a wooden door.

2. The self-heat preservation building structure according to claim 1, wherein each of the spigots is a trapezoid opening with a large upper end and a small lower end.

3. The self-heat preservation building structure according to claim 1 or 2, wherein opposite surfaces of the at least one independent foundation are provided with a tongue-and-groove joint and an end port for containing a bolt.

4. The self-heat preservation building structure according to claim 1, wherein one end or two opposite ends of the criss-cross straight slots in the upper end of the wooden pillars are provided with corbels, and the upper end surfaces of the corbels are kept flush with bottom surfaces of the criss-cross straight slots.

5. The self-heat preservation building structure according to claim 1, wherein each of the floor, the wallboard, the ceiling board and the roof board comprises a tongue-and-groove shaped three-layer sandwich combination, a sandwich layer comprises a light heat preservation material, and three layers of boards are linked and fixed by bolts.

6. The self-heat preservation building structure according to claim 1 or 5, wherein outer sides of the roof board and the wall board are coated with an anti-radiation, anticorrosive and waterproof material.

* * * * *